US011608992B2

(12) United States Patent
Deivasigamani et al.

(10) Patent No.: US 11,608,992 B2
(45) Date of Patent: Mar. 21, 2023

(54) ON-DEMAND TANKLESS HIGH VOLUME CAPABLE WATER HEATING SYSTEM

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 182 days.

(21) Appl. No.: 17/133,720

(22) Filed: Dec. 24, 2020

(65) Prior Publication Data

US 2021/0116135 A1 Apr. 22, 2021

Related U.S. Application Data

(63) Continuation-in-part of application No. 16/114,512, filed on Aug. 28, 2018, now Pat. No. 10,907,840, which is a continuation-in-part of application No. 14/506,004, filed on Oct. 3, 2014, now abandoned.

(60) Provisional application No. 61/886,247, filed on Oct. 3, 2013.

(51) Int. Cl.

| | |
|---|---|
| ***F24D 3/02*** | (2006.01) |
| ***F24D 3/08*** | (2006.01) |
| ***F24D 19/10*** | (2006.01) |
| ***F24D 13/00*** | (2006.01) |

(52) U.S. Cl.

CPC ..... *F24D 19/1069* (2013.01); *F24D 3/02* (2013.01); *F24D 3/08* (2013.01); *F24D 13/00* (2013.01); *F24D 2220/042* (2013.01); *F24D 2220/044* (2013.01)

(58) Field of Classification Search

CPC ..... F24D 17/0078; F24D 17/0026; F24D 19/1051; F24D 19/06; F24H 9/139

USPC ... 122/13.01, 14.1, 14.2, 14.3, 448.1, 448.3, 122/448.4, 367.1, 510

See application file for complete search history.

(56) References Cited

U.S. PATENT DOCUMENTS

| | | | | |
|---|---|---|---|---|
| 4,607,615 | A * | 8/1986 | Boals | F16K 17/105 137/334 |
| 4,869,232 | A * | 9/1989 | Narang | F24H 1/207 122/18.31 |
| 5,857,482 | A * | 1/1999 | Dowling | H01H 35/42 122/504 |
| 8,175,752 | B2 | 5/2012 | Deivasigamani et al. | |

(Continued)

*Primary Examiner* — Ko-Wei Lin

(74) *Attorney, Agent, or Firm* — Tracy Jong Law Firm; Tracy P. Jong; Cheng Ning Jong

(57) ABSTRACT

A method for controlling an on-demand high volume capable fluid heating system that supplies a total heating power at a turndown ratio and a total flowrate of a fluid supply, the fluid heating system comprising a plurality of heat exchangers fluidly connected in parallel, each of the plurality of heat exchangers comprising: a fluid conductor, wherein each of the plurality of heat exchangers contributes to the total heating power and a portion of the total flowrate of the fluid supply through the fluid conductor; an inlet conductor configured to connect the fluid supply to the plurality of heat exchangers; an outlet conductor configured for receiving the fluid supply downstream of the plurality of heat exchangers; an auxiliary conductor connecting the inlet conductor at a first location and the outlet conductor, the auxiliary conductor comprising a modulating valve; and a pump disposed downstream from the first location on the inlet conductor.

9 Claims, 10 Drawing Sheets

(56) References Cited

U.S. PATENT DOCUMENTS

| | | | | |
|---|---|---|---|---|
| 8,271,143 | B2 | 9/2012 | Deivasigamani et al. | |
| 8,286,594 | B2 | 10/2012 | Smelcer | |
| 8,656,867 | B2 | 2/2014 | Deivasigamani et al. | |
| 8,971,694 | B2 * | 3/2015 | Deivasigamani | F24D 17/0078 392/307 |
| 2008/0216771 | A1 * | 9/2008 | Paine | F24D 19/1009 122/14.2 |
| 2008/0257894 | A1 * | 10/2008 | Podd | B65D 90/041 134/42 |
| 2009/0211644 | A1 * | 8/2009 | Wylie | F24H 1/122 137/337 |
| 2009/0255479 | A1 * | 10/2009 | Boudreau | A01K 63/02 119/201 |
| 2010/0195991 | A1 * | 8/2010 | Deivasigamani | F24H 9/2035 137/340 |
| 2010/0198417 | A1 * | 8/2010 | Deivasigamani | G05D 23/1927 700/282 |
| 2010/0263606 | A1 * | 10/2010 | Beckett | F24D 11/004 122/367.1 |
| 2011/0303165 | A1 * | 12/2011 | Adachi | F24D 19/1054 122/448.1 |
| 2012/0090560 | A1 * | 4/2012 | Iwama | F24H 9/139 122/14.3 |
| 2012/0138149 | A1 * | 6/2012 | Hatada | G05B 15/02 122/367.1 |
| 2012/0191256 | A1 | 7/2012 | Deivasigamani et al. | |
| 2013/0312671 | A1 * | 11/2013 | Deivasigamani | G05D 23/1919 122/1 C |

* cited by examiner

PRIOR ART FIG. 1

ON-DEMAND TANKLESS HIGH VOLUME CAPABLE WATER HEATING SYSTEM

PRIORITY CLAIM AND RELATED APPLICATIONS

This continuation-in-part application claims the benefit of priority from non-provisional application U.S. Ser. No. 16/114,512 filed on Aug. 28, 2018 which in turn claims the benefit of priority from non-provisional application U.S. Ser. No. 14/506,004 filed on Oct. 3, 2014 which in turn claims the benefit of priority from provisional application U.S. Ser. No. 61/886,247 filed on Oct. 3, 2013. Each of said applications is incorporated by reference in its entirety.

BACKGROUND OF THE INVENTION

1. The Field of the Invention

The present invention is directed generally to a multi heat exchanger water heating system. More specifically, the present invention is directed to an on-demand tankless high volume capable water heating system.

2. Background Art

Applicants' U.S. Pat. Nos. 8,175,752 and 8,271,143 disclose the use of a plurality of water heating systems in a network. While this system is scalable as the number of water heaters functionally and fluidly connected to the network can be incremented and decremented based on need, the level of skill, effort and costs associated with fluidly networking a large number of water heaters can be high and not easily attainable. In networking a plurality of water heaters, each inlet of a water heater is plumbed on-site to a cold water supply line and each outlet of the water is plumbed on-site to an output line to points of usage. This causes significant amounts of work performed, e.g., in measuring and cutting pipe fittings on-site and a significant number of pipe fittings. The decision associated with connecting each water heater to a cold water supply line and an output line is typically made by an installer on-site who works under various constraints such as time, space and limited access to client's space, and the like. The amount of wall-space and total size of footprint taken, by not only the water heaters, but also the plumbing for hot and cold water pipes and exhaust gases can be significant, especially when the network of water heaters is placed in a small mechanical room. In addition, each exhaust of a water heater is connected to an individual vent that eventually culminates in a common vent that vents into an exterior space.

U.S. Pat. No. 8,286,594 to Smelcer (hereinafter Smelcer) discloses a water heating apparatus capable of turndown ratios as high as 25:1. Such turndown ratios are achieved using multiple blowers and one heat exchanger. As there is only one heat exchanger, a failure in the heat exchanger can still potentially shut down the entire water heating apparatus. In contrast, the present water heating system uses its heat source from more than one heat exchanger. Column 2 lines 3-19 of Smelcer discloses challenges faced when improving turndown ratios using multiple modulating systems as follows: "Inherent physical limitations on the turndown ratio which can be achieved with a single heating apparatus of prior designs makes it difficult to achieve a continuous range of heat input over a large operating range from a very low low end for low heat demand situations to a very high high end for high heat demand situations. One prior solution to this difficulty is to utilize a plurality of commonly controlled heat exchangers such as those of the Baese et al. patent described above. One such system is described for example in U.S. Patent Application Publication No. 2008/0216771 of Paine et al., and assigned to the assignee of the present invention. While such multiple modulating systems do solve the problem of providing continuous modulation over a wide range of heat demands, they do so at the cost of increased complexity of plumbing to connect the multiple units and increased complexity of control systems to coordinate the operation of the units."

Thus, there arises a need for a unitary multi heat exchanger water heating system capable of a high turndown ratio but large heating capacity, having a simplified control scheme due to independently controlled heat exchangers, having simplified control hardware due to shared components, e.g., a recirculation pump.

SUMMARY OF THE INVENTION

The present invention is directed toward a method for controlling an on-demand high volume capable fluid heating system for supplying a total heating power at a turndown ratio and a total flowrate of a fluid supply, the fluid heating system including a plurality of heat exchangers fluidly connected in parallel, each of the plurality of heat exchangers including: a fluid conductor, wherein each of the plurality of heat exchangers contributes to the total heating power and a portion of the total flowrate of the fluid supply through the fluid conductor; an inlet conductor configured to connect the fluid supply to the plurality of heat exchangers at an upstream location of the plurality of heat exchangers; an outlet conductor configured for receiving the fluid supply downstream of the plurality of heat exchangers; an auxiliary conductor connecting the inlet conductor at a first location and the outlet conductor, the auxiliary conductor including a modulating valve; and a pump disposed downstream from the first location on the inlet conductor, wherein the pump is disposed upstream from the plurality of heat exchangers, the method including:

(a) controlling the modulating valve to cause a bypass flow through the auxiliary conductor in a first flow mode from the inlet conductor to the outlet conductor; and (b) increasing a temperature setpoint of one or more of the plurality of heat exchangers to produce a heated flow at an intermediate temperature that is higher than a resultant temperature, the heated flow configured to be mixed with the bypass flow to form the fluid supply at the resultant temperature.

In one embodiment, the on-demand high volume capable fluid heating system is tankless. In one embodiment, the on-demand high volume capable fluid heating system further includes a user interface operably connected to the plurality of heat exchangers. In one embodiment, the on-demand high volume capable fluid heating system further includes an enclosure within which the plurality of heat exchangers and the pump are located, the enclosure includes a pallet base having fork pockets adapted to facilitate the transport of the enclosure with a forklift. In one embodiment, the modulating valve is disposed in a first setting to cooperate with the pump to generate an internal circulation through at least one of the plurality of heat exchangers while supplying the total heating power in the first flow mode. In one embodiment, the modulating valve is disposed in a second setting to cooperate with the pump to generate an internal circulation through at least one of the plurality of heat exchangers a portion of the time outside of supplying the total heating power in the first flow mode. In one embodiment, the on-demand high volume capable fluid heating system further includes an external recirculation circuit. In one embodiment, the turndown ratio is at least about 33.3:1. In one embodiment, the total flowrate is up to about 50 Gallons Per Minute (GPM). In one embodiment, each of the plurality of heat exchangers further includes a top casting including a backflow preventer. In one embodiment, the method further includes disposing the modulating valve in a closed position, forcing the fluid supply through the pump and the plurality of heat exchangers such that the fluid supply remains capable of being heated to mitigate a failure of the pump.

Accordingly, it is a primary object of the present invention to provide an on-demand high volume capable water heating system having a high turndown ratio. In one embodiment, the firing rate of the present water heating system ranges from about 30,000 BTU to about 1,000,000 BTU. In one embodiment, the present turndown ratio is about 33.3:1.

It is another object of the present invention to provide an on-demand high volume capable water heating system having a high turndown ratio that is also simple to install.

It is another object of the present invention to provide an on-demand high volume capable water heating system having a high turndown ratio that includes a recirculation circuit which aids in meeting target temperature expediently.

It is another object of the present invention to provide a high volume capable water heating system having a high turndown ratio that includes only one recirculation circuit which aids in meeting target temperature expediently.

It is another object of the present invention to provide an exhaust manifold configured to receive exhaust from more than one heat exchanger, eliminating the need for an exhaust for each of a plurality of heat exchangers which make up a heating system.

It is another object of the present invention to provide a heating system with an arrangement of its components that reduces or eliminates occurrences of cavitation.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
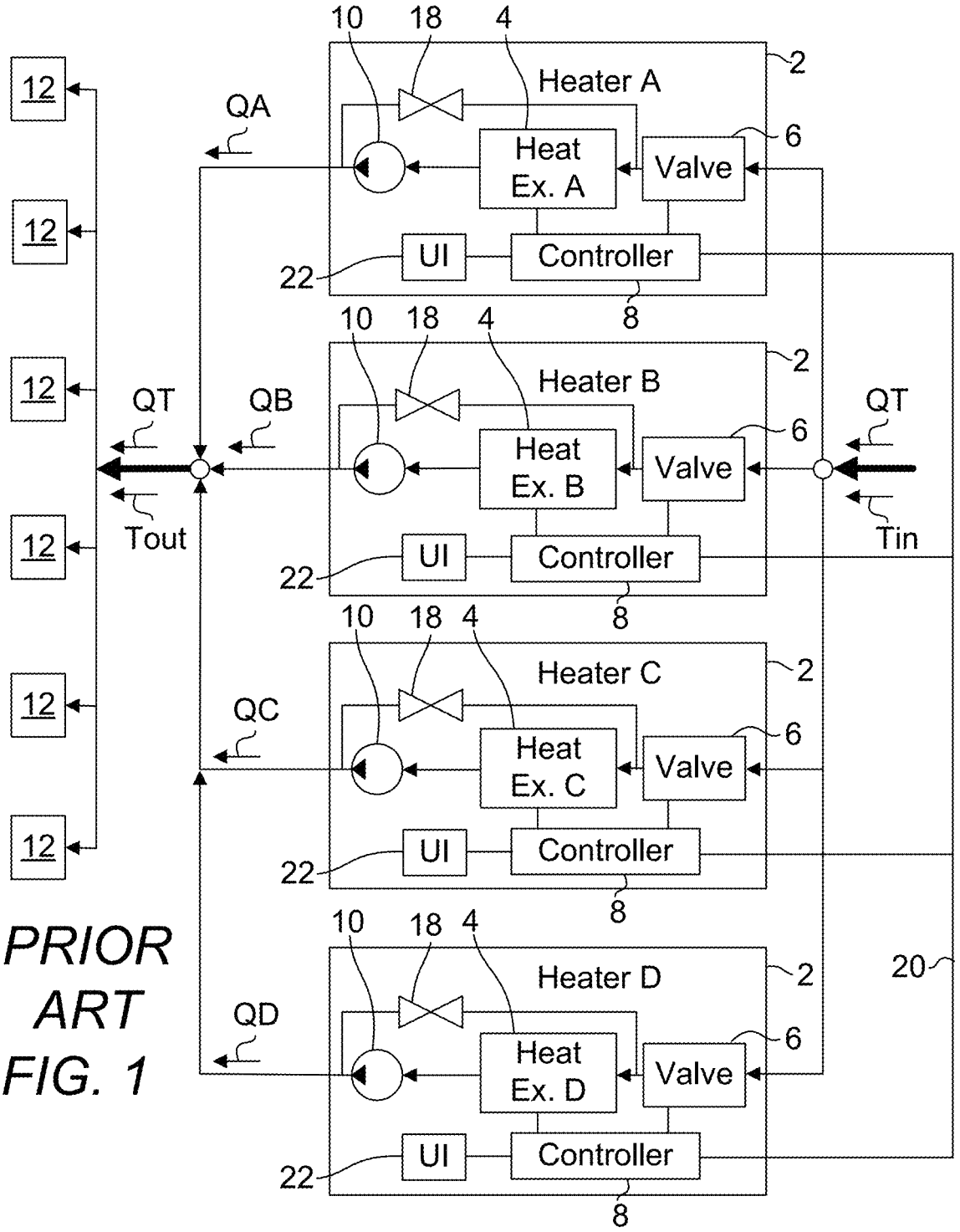
FIG. 1 is a block diagram depicting a prior art water heating network having multiple water heating systems.

2—water heater
4—heat exchanger
6—valve
8—controller
10—pump
12—point of demand
14—check valve
16—sub-module of water heater
18—modulating valve
20—network
22—user interface
24—exhaust port
26—gas inlet
28—hot water outlet
30—air intake
32—cold water inlet
34—condensate drain
36—fork lift pockets
38—enclosure
40—door of enclosure
42—door latch
44—points of demand
46—external recirculation circuit
48—flapper
50—flapper opening for fuel/air mixture flow path
52—ridge on which cover is disposed
54—cavity leading to a burner
56—fuel/air mixture flow

58—top casting
60—direction in which flapper rotates to enable flapper opening
62—pivot mechanism of flapper
64—modulating valve
66—burner
68—flue gas flow
70—flowrate sensor
72—auxiliary conductor
74—inlet conductor
76—outlet conductor

PARTICULAR ADVANTAGES OF THE INVENTION

The present configuration reduces the amount of materials used in the form of pumps, fittings, plumbing, wiring, etc., and the footprint of the water heater and simplifies plumbing and the design of exhaust manifold.

A large conventional single-heat exchanger water heater is often desired in circumstances where ease of installation is critical. Unlike a conventional single-heat exchanger water heater, the present configuration provides modulation of heating power unavailable in large single-heat exchanger water heaters as the turndown ratio of the conventional single-heat exchanger water heater is no better than about 24:1.

In addition, by using more than one heat exchanger, single point failures can be eliminated as heating contribution of a disabled heat exchanger may be made up by remaining functioning heat exchangers until repair or replacement can be performed.

A major drawback for using a single-heat exchanger water heater lies in the inability of such a unit to tolerate faults. If the heat exchanger ceases to function, the entire water heater is rendered inoperable. The present configuration includes multiple heat exchangers, thereby greatly reducing the chance of having a total shutdown due to an inoperable heat exchanger.

The recirculation circuit provides temperature stability when flow demand changes from a high rate to a low rate, e.g., from about 20 Gallons Per Minute (GPM) to about 5 GPM. At a supply temperature of 120 degrees F., a sudden decrease in supply from about 20 GPM to about 5 GPM causes a magnitude of temperature fluctuation of only about ±7 degrees F. Without recirculation, this temperature fluctuation can range from about ±25 to about ±30 degrees F. A sudden decrease is defined as a decrease in demand of from about 0.5 to about 1.5 GPM that occurs over a period of about 3 to about 4 seconds.

As the present water heating system is tankless, hot water is generated and consumed on demand. No storage of hot water is necessary or desired, eliminating heat loss wastes that can occur as in tank water heaters. The present water heating system is capable of a total flowrate of from a low flowrate of about 0.6 GPM to a high flowrate of about 50 GPM due to the combined use of multiple heat exchangers. When a demand is low, a small number of heat exchangers may be operated at maximum firing rate while others are not activated or each heat exchanger may be operated at a rate that is less than the maximum firing rate to provide a total heating rate that meets the low demand. When a demand is high, a large number or all of the heat exchangers may be operated at high or maximum firing rate to meet the high demand. The present water heating system therefore can provide hot water at such a large range of flowrates. When using a single large heat exchanger water heater, the possibility that a large storage tank is required such that sufficient hot water can be prepared before an actual demand exists is much greater as the firing rate of the single large heat exchanger cannot be modulated. Therefore, a higher than necessary firing rate is required in a single large heat exchanger water heater.

In one embodiment, a pump is disposed upstream of a plurality of heat exchangers. When coupled with an auxiliary conductor, the pump allows recirculation or a bypass flow in a present system without or with minimal negative effects of cavitation. As the present system is capable of a low or reduced pressure drop across the system, it is capable of meeting large demands traditionally served using tank heaters.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

When a large demand of heated water is required, e.g., in a hotel, a convention center or a processing plant, one of two solutions is typically adopted. A large water heater, e.g., one having firing rate of about 1,000,000 BTU, with a single large heat exchanger that is capable of producing and storing a large amount of heated water may be used. More recently, with the advancements made in communication technology, solutions involving multiple units of smaller capacity water heaters have become common place. The present water heating system marks a departure from strict embodiments of the types of water heaters described above. A major drawback for using a single-heat exchanger water heater lies in the inability of such a unit to tolerate faults. If the sole heat exchanger of such a water heater ceases to function, the entire water heater is rendered inoperable. Another major drawback for using a single-heat exchanger water heater lies in the inability to allow change-outs/services without affecting normal operations of the water heater. The present configuration includes multiple heat exchangers, thereby greatly reducing the chance of having a total shutdown due to an inoperable heat exchanger or services being performed on the heat exchanger. When one heat exchanger is inoperable, other heat exchangers can function and may still provide the firing rate required. Unless the maximum available firing rate is required (which is not often the case or may never occur), the use of multiple heat exchangers can almost always meet a demand until a repair or replacement of a faulty part in the water heating system can be made. In addition, as the components used in the present water heating system are smaller, e.g., smaller blowers (each for one heat exchanger instead of a single large unit), the cost of replacing such parts is significantly lower than the cost for replacing a large blower suitable for forcing mixture of fuel/air through the combustion system of a single large heat exchanger. As each heat exchanger in the present water heating system is capable of a large turndown ratio, it is possible that certain demands in an installation can be met by a number of heat exchangers that is less than that of the total number of heat exchangers in the present water heating system, leaving at least one heat exchanger that is not used. Therefore, the present water heating system can have the effect that some heat exchangers (and hence their components) accumulate service hours that are significantly lower than those experienced in a single large heat exchanger within a service period.

FIG. 1 is a block diagram depicting a prior art water heating network having multiple water heaters. In this example, four water heaters 2 are functionally connected to supply a total heating power to meet a total demand requested at several points of demands 12. QT represents the total flowrate demanded. Each of QA, QB, QC and QD represents the individual flowrate through water heater A, B, C and D, respectively. Tin represents the temperature of the unheated or input water flow. Tout represents the temperature of the heated or output flow. Each water heater 2 is functionally connected to a network of water heaters 2, thereby capable of participating in determining the amount of heating power required from each of the water heaters 2. Each water heater is equipped with a controller 8, a valve 6 for allowing a flow at a flowrate through a heat exchanger 4, a user interface 22 for displaying pertinent water heating status and fault information and facilitating access to a user requesting information from a controller 8 or effectuating operating settings of the controller, a recirculation circuit having a pump 10 and a modulating valve 18. A pump 10 selectively recirculates water of a water heater 2 to distribute heat energy evenly within the heated water supplied by each water heater 2 either while the water heater 2 delivers hot water or while the demand for water from the water heater has ceased. A modulating valve 18 determines the amount of recirculation is to be performed. When recirculation is desired, a pump 10 is turned on and its corresponding modulating valve 18 is opened to a suitable setting to enable a recirculation flow which displaces at least a portion of the flow from the output of a corresponding heat exchanger 4 and to merge the recirculation flow with either an incoming cold water flow if a demand exists or circulating the heated water in the recirculation circuit in an attempt to even out temperature discrepancies between the portion of a fluid conductor disposed in the water heater and other portions of the fluid conductor of the recirculation circuit. The controllers 8 of all four water heaters are functionally connected such that the contribution of each water heater can be determined. When a water heater is decommissioned for repair or otherwise out of service, the water heater will not initialize properly and therefore not considered as a water heater contributing partial heating power to the total heating power required to meet a demand. A user interface is functionally connected to the communication bus of the network 20 such that any communication between a user and a water heater can be made via the user interface directly through the communication bus. In one embodiment, the communication bus is configured according to RS 485. Several other protocols may also be used, e.g., Controller Area Network (CAN), etc. Reference is further made to the Applicants' patents and co-pending application, U.S. Pat. No. 8,175,752 ('752), U.S. Pat. No. 8,271,143 ('143) and U.S. Pat. Pub. No. 20120191256 ('256), respectively, for water heaters capable of functional connection to a network to cooperatively contribute to the total heating power required in a system, the disclosures of '752, '143 and '256 are hereby incorporated by reference in their entirety.

Figure 2:
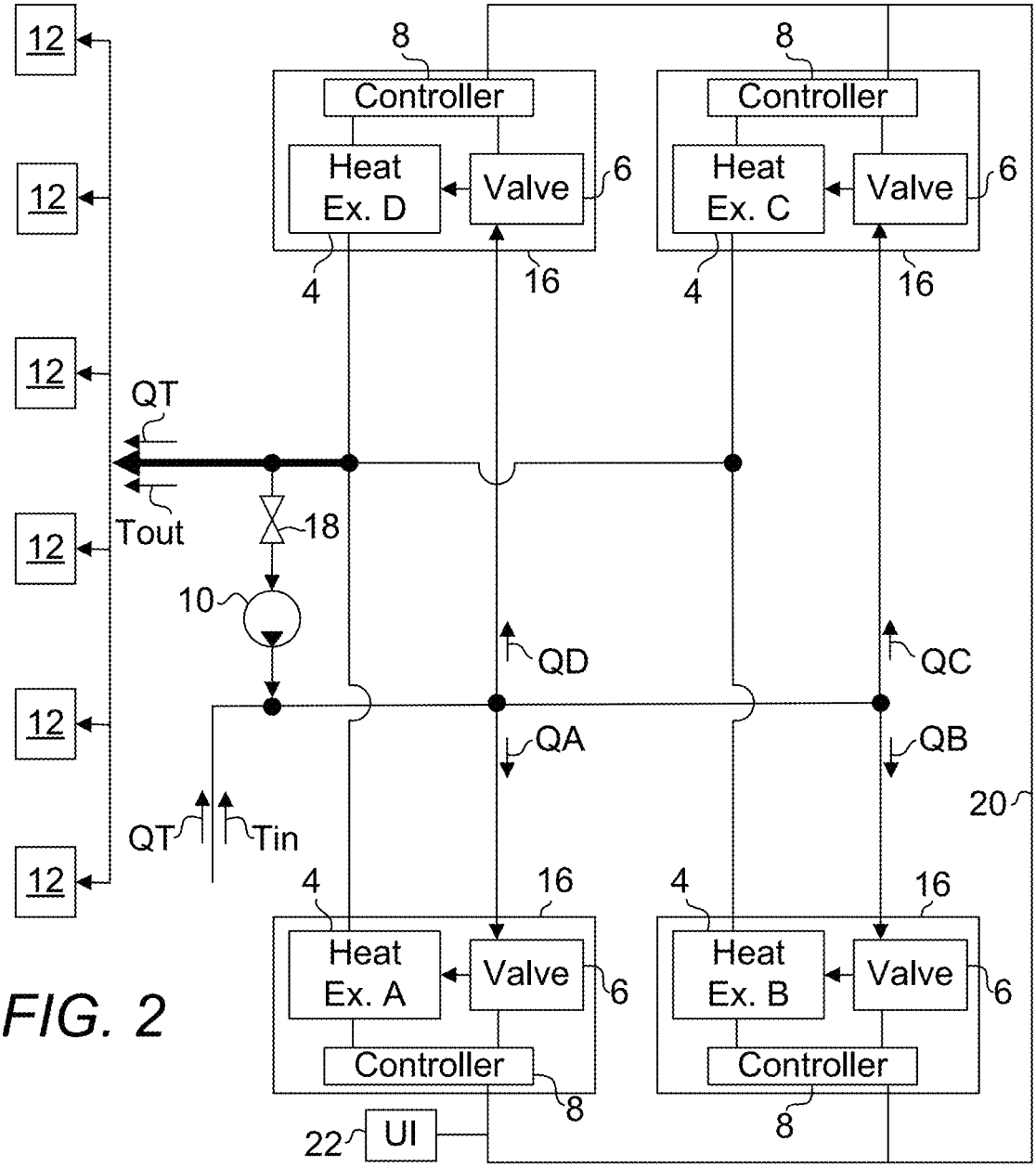
FIG. 2 is a block diagram depicting a water heating system comprised of a single package including multiple heat exchangers and one embodiment of a recirculation circuit.

FIG. 2 is a block diagram depicting a water heating system comprised of a single package including multiple heat exchangers and one embodiment of an internal recirculation circuit. In a preferred embodiment, the water heating system is tankless.

In one embodiment, a heat exchanger may be coupled with a buffer tank according to Applicants' patent U.S. Pat. No. 8,656,867 ('867) for coil tube heat exchangers, the disclosure of '867 is hereby incorporated by reference in its entirety. In this example, a fluid conductor connecting the cold water inlet and hot water outlet enables recirculation to occur. A pump 10 is connected in line with a modulating valve 18 within this fluid conductor. In practice, a recirculation flow occurs when the pump 10 is turned on, drawing heated water from the outlet towards the inlet, thereby mixing the heated water with the cooler incoming water if a demand exists (i.e., drawing cold water at inlet) or the cooler water upstream of the heat exchanger (i.e., prior to arriving at the heat exchanger that has just been turned off). The modulating valve 18 serves to modulate an unheated water flowrate from the inlet to the outlet based on the desired resultant temperature at the outlet. For instance, if the water temperature at the outlet trends upwardly and there is a risk the outlet temperature will exceed the setpoint temperature of the water heating system, the modulating valve 18 is set at a position to allow a larger flow to temper the output from one or more of the heat exchangers 4. In making the fluid network, all inlets are connected together and the outlets are connected together. It shall be noted that only one recirculation circuit is necessary to cause recirculation in all heat exchangers as compared to the configuration shown in FIG. 1. It shall also be noted that only one user interface 22 is necessary to allow interactions between a user and the controllers 8 of each water heater as compared to the configuration shown in FIG. 1. In one embodiment, the present water heating system is made up of four heat exchangers, each having a firing rate of about 30,000 BTU to 250,000 BTU. The effective firing rate therefore ranges from about 30,000 BTU (when one heat exchanger is used) to 1,000,000 BTU (when all heat exchangers are used). The turndown ratio is then the highest firing rate divided by the lowest firing rate, i.e., 1,000,000 BTU/30,000 BTU or 33.3:1. In one embodiment, each heat exchanger 4 is part of a sub-module 16 which also includes a valve 6 where both the heat exchanger 4 and valve 6 are controlled by a controller 8.

Figure 3:
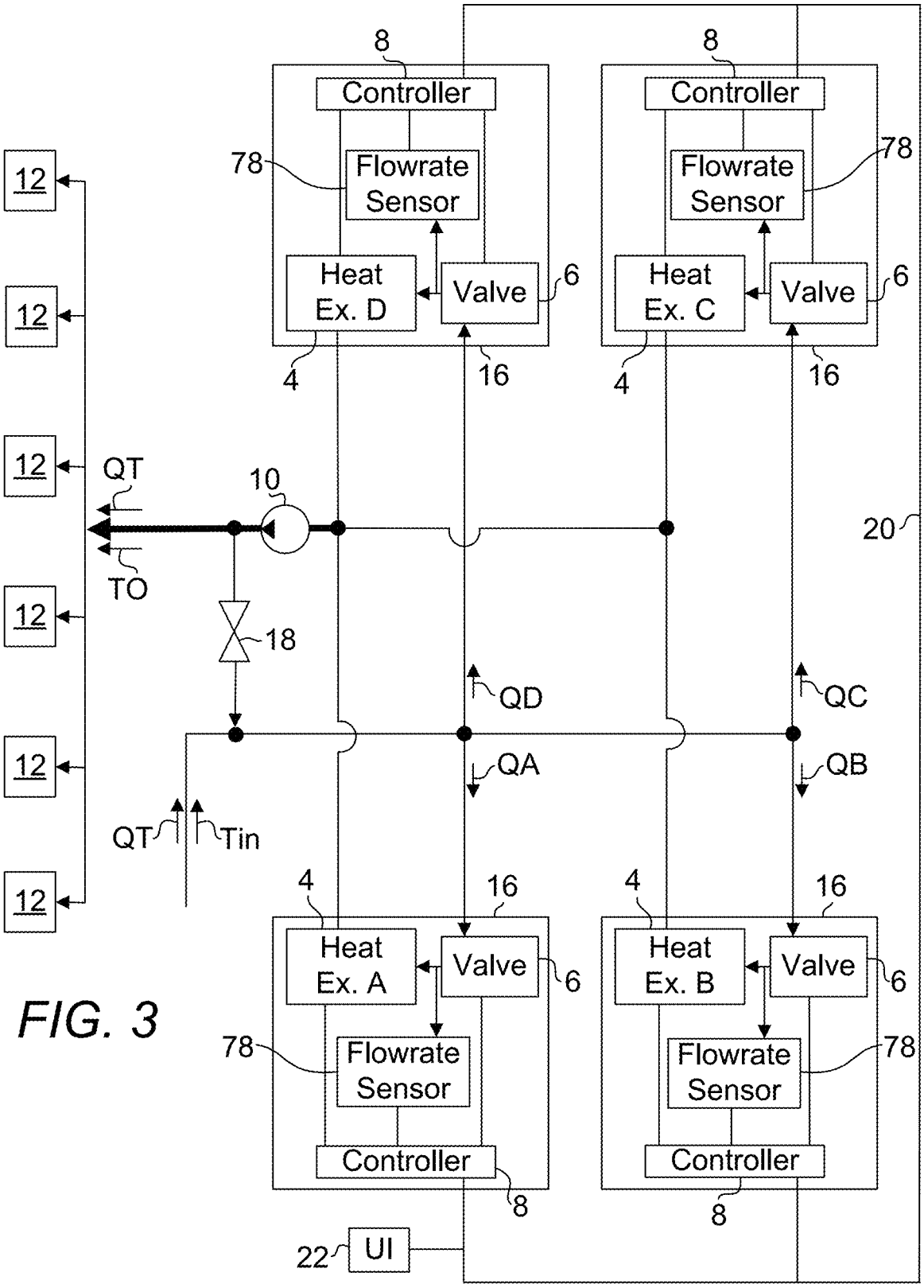
FIG. 3 is a block diagram depicting a water heating system comprised of a single package including multiple heat exchangers and another embodiment of an internal recirculation circuit.

FIG. 3 is a block diagram depicting a water heating system comprised of a single package including multiple heat exchangers and another embodiment of an internal recirculation circuit. In this embodiment, the internal recirculation circuit is comprised of a pump 10 fluidly connected to the outlet and configured to push fluid in the direction from the inlet to the outlet and a modulating valve 18 that is connected to a fluid conductor connecting the cold water inlet and hot water outlet. Recirculation can occur when the pump 10 is turned on and the modulating valve opened while a hot water demand exists or when a hot water demand has ceased. As the pressure exerted by the pump 10 while turned on is higher than the pressure of fluid entering the inlet, an opening of the modulating valve 18 can cause a flow from the outlet to the inlet and not a flow from the inlet to the outlet.

Figure 3A:
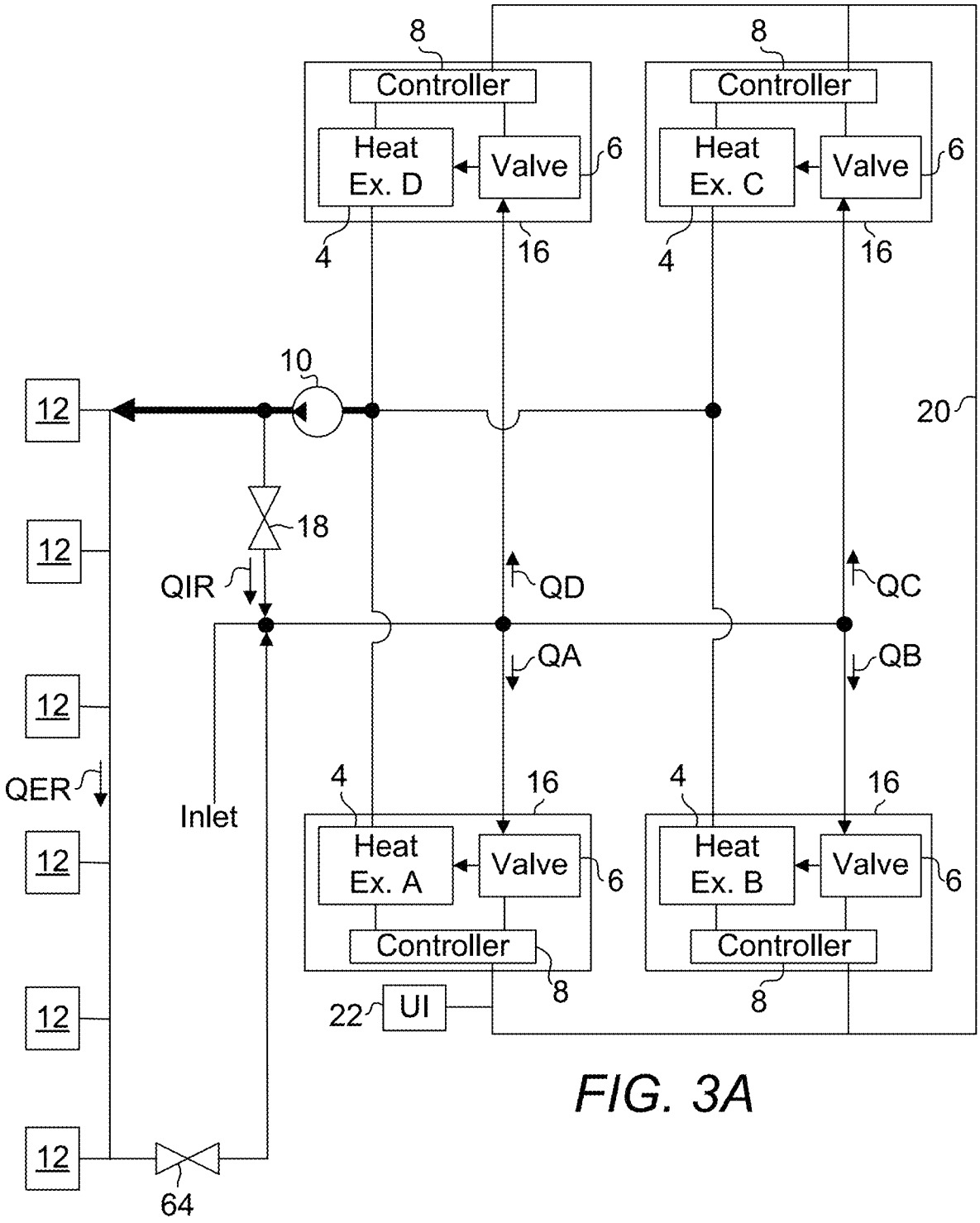
FIG. 3A is a block diagram depicting a water heating system comprised of a single package including multiple heat exchangers and the embodiment of internal recirculation circuit of FIG. 3 and an external recirculation circuit.

FIG. 3A is a block diagram depicting a water heating system comprised of a single package including multiple heat exchangers 4 and the embodiment of internal recirculation circuit of FIG. 3 and an external recirculation circuit 46. Using modulating valves 64, 18, an external recirculation, an internal recirculation or a combined external and internal recirculation can be activated. When an external recirculation is desired, modulating valve 64 is opened to allow flow QER. When an internal recirculation is desired, modulating valve 18 is opened to allow flow QIR. Each of the sizes of QER and QIR is modulated by adjusting modulating valve 64 and 18, individually or in combination. For instance, the size of QER can be increased by reducing QIR or further reducing the flowrate through modulating valve 18. By the same token, the size of QIR can be increased by reducing QER or further reducing the flowrate through modulating valve 64. In one embodiment, a modulating valve 18, 64 is a solenoid valve. It shall be noted again that a single pump 10 is capable of causing either one or both of the internal recirculation and external recirculation.

Figure 4:
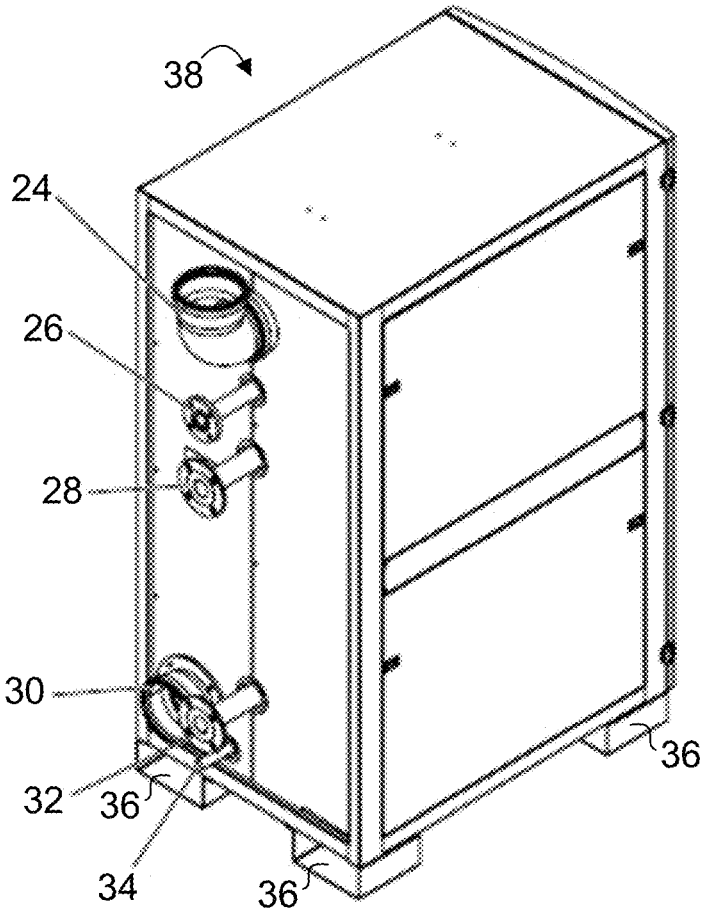
FIG. 4 is a top rear perspective view of one embodiment of the packaging of the water heating system, depicting the availability of forklift pockets to facilitate transportation of the water heating system and the ports protruding from the enclosure for functional connection with the environment in which the water heating system is placed.

FIG. 4 is a top rear perspective view of one embodiment of the packaging of the water heating system, depicting the availability of forklift pockets to facilitate transportation of the water heating system and the ports protruding from the enclosure for functional connection with the environment in which the water heating system is placed. The enclosure comprises a pallet base having fork pockets 36 configured such that the enclosure 38 is transportable by a forklift. A plurality of ports are configured to protrude from the rear panel of the enclosure 38 to facilitate connections of various supply, exhaust or exit lines from the enclosure 38. An exhaust manifold disposed within the enclosure 38 culminates in an exhaust port 24 which protrudes from the rear panel of the enclosure 38. The ports include a gas inlet 26 for receiving a supply of fuel into each burner of the heat exchangers, a cold water inlet 32, a hot water outlet 28, an air intake 30 for receiving air to be mixed with the supply of fuel, a hot water outlet for delivering hot water to points of demand and a condensate drain 34.

Figure 5:
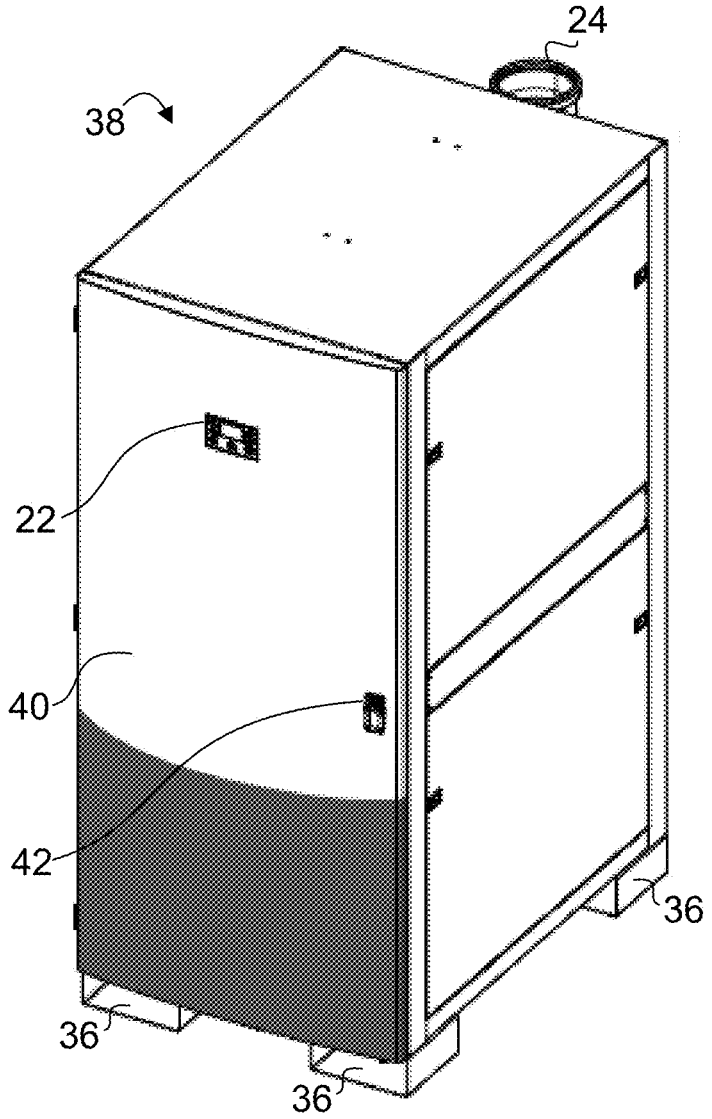
FIG. 5 is a top front perspective view of one embodiment of the packaging of the water heating system, depicting a user interface disposed on a front surface of the water heating system.
Figure 6:
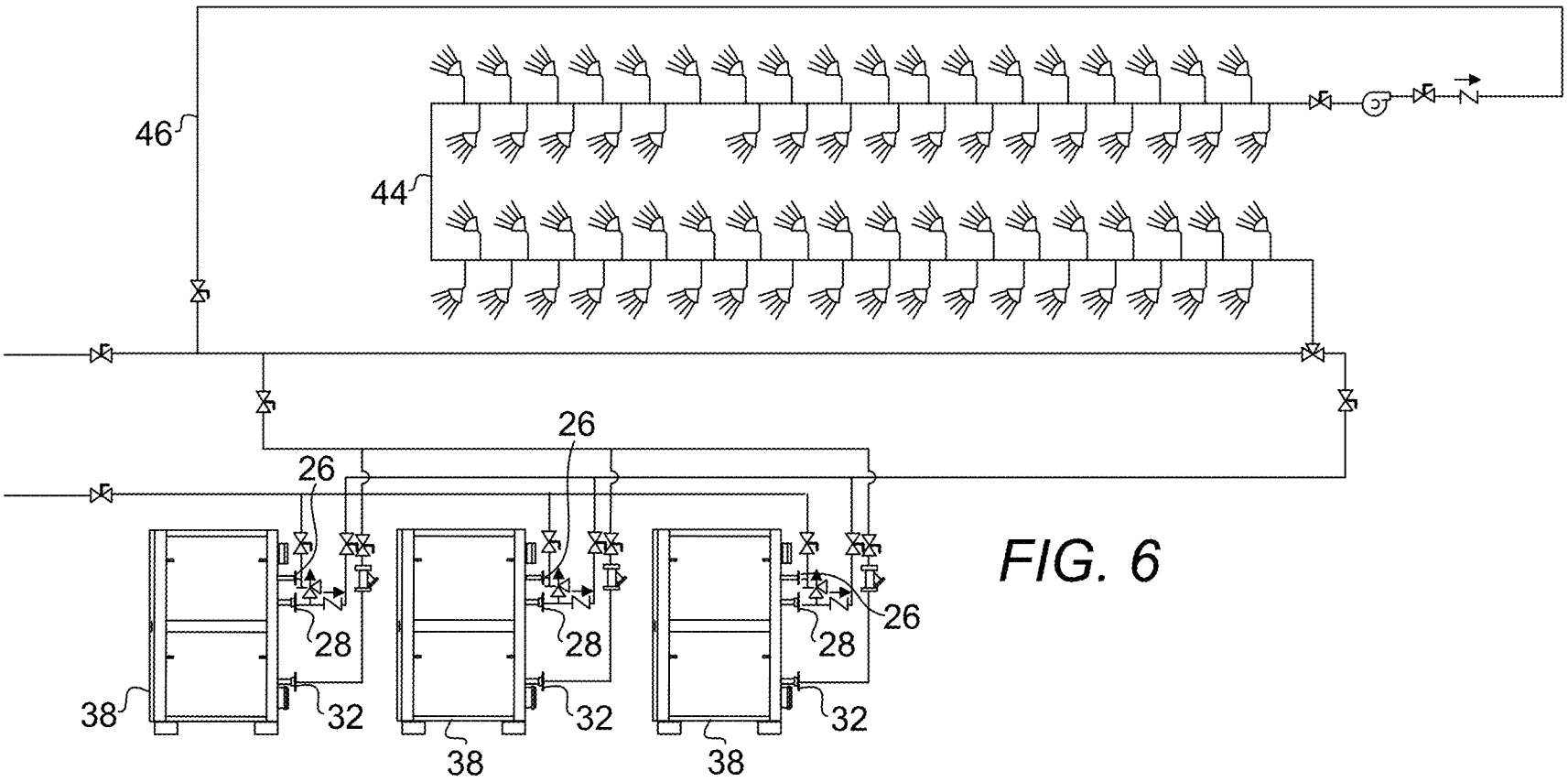
FIG. 6 is a diagram depicting the use of several units of the present water heating systems to provide a total system with an even higher turndown ratio.

FIG. 5 is a top front perspective view of one embodiment of the packaging of the water heating system, depicting a user interface 22 disposed on a front surface of the water heating system. It shall be noted that a door 40 is made available in front of the water heating system to allow access to the interior of the enclosure 38. A door latch 42 is configured to facilitate opening, closing, locking or securing of the door 40 that is hingedly connected to a portion of the enclosure 38. A user interface 22 is preferably made available on the front surface of the water heating system. In one embodiment, a cutout is made in the door 40 to enable the display of the user interface 22 through the door 40. In another embodiment, a user interface 22 is mounted on the door 40. FIG. 6 is a diagram depicting the use of several units of the present water heating systems to provide a total system with an even higher turndown ratio. In this example, three water heating systems, each having a combined firing rate of 1,000,000 BTU, are connected to provide a total firing rate ranging from about 30,000 BTU (when one heat exchanger of only one water heating system is used) to 3,000,000 BTU (when all heat exchangers of all three water heating systems are used). A cold water supply line is simply connected to the cold water inlet 32 of each water heating system while the outlet 28 of each water heating system is connected to various points of demand 44. Fuel supply is connected to the gas inlet 26 of each water heating system.

Figure 7:
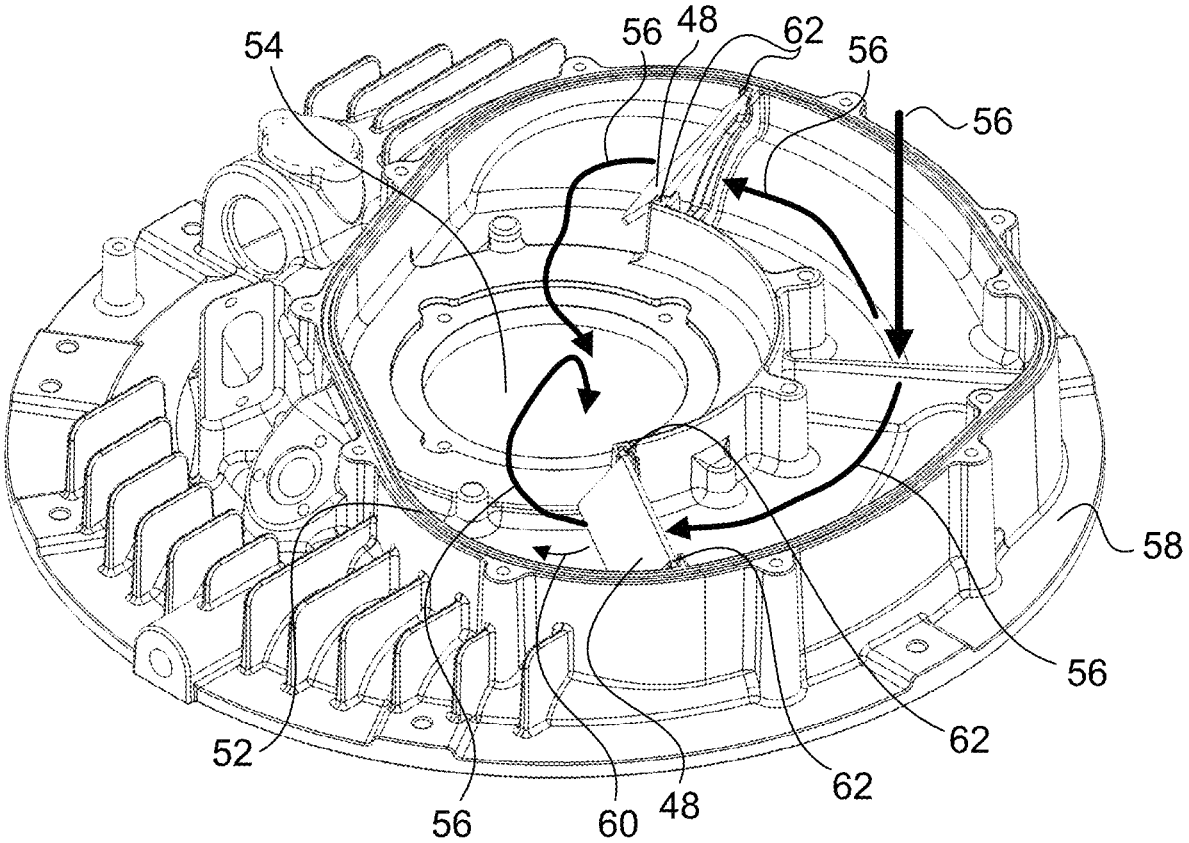
FIG. 7 depicts the use of flappers in a top casting of each of the heat exchangers of the present water heating system to prevent backflows of exhaust into the top casting as the heat exchangers share a single exhaust manifold.

FIG. 7 depicts the use of flappers in a top casting of each of the heat exchangers of the present water heating system to prevent backflows of exhaust into the top casting 58 as the heat exchangers share a single exhaust manifold. Flappers 48 are shown in an open position. A top casting 58 is depicted in each of FIG. 7 with its cover removed to reveal fuel/air mixture flow 56 paths which originate from a flow which enters via the cover downwardly into the top casting 58 (Note the ridge 52 on which a cover is normally disposed). The flow 56 paths culminate and exit into a cavity 54 leading to a burner (not depicted). As a fuel/air mixture flow 56, aided upstream of the top casting by a blower, is fed into top casting 58, it splits into two flows 56, each pushing a flapper 48 mounted in its path, in direction 60 about pivot mechanisms 62 to result in an opening 50 to allow a flow 56 to continue into the cavity 54. When a flow 56 ceases, each flapper 48 returns to its closed position to seal the opening 50, thereby preventing any flue/exhaust gases (both from the heat exchanger where its fuel/air mixture flow 56 had just ceased and heat exchangers which are still active) from entering the top casting. A flapper 48 opens in one direction only, i.e., direction 60 and closes to any flow in the direction opposite to direction 60, therefore preventing any potential backflow of flue gases exiting via the air intake port of the top casting.

Flappers 48 are installed downstream from a blower. This is in contrast to a conventional backflow preventer which is mounted upstream of a blower. A flapper 48 is essentially operated by the difference in air pressures on either side of the flapper 48. By mounting the flappers 48 downstream of the blower, a positive pressure is exerted on the flappers, causing them to open. If the flappers 48 were mounted upstream of the blower, i.e., at the blower's inlet, then the flappers 48 will have to be opened by a vacuum created upstream of the blower. As centrifugal blowers are not positive displacement devices, this will cause the need of a significant drop of air flow to achieve vacuum to result in the force needed to open the flappers 48. Hence the present flappers 48 are mounted downstream from a blower. The flappers 48 could be mounted downstream from a combustion chamber of a heat exchanger. However, the Applicants discovered that the flappers 48 may fail to open if the flappers 48 are disposed downstream of a heat exchanger as the flue gas from a burner contains water vapors and carbon-dioxide. Water vapors can freeze and cause the flappers 48 to stick (or remain stuck closed). The carbon particles of the carbon dioxide and other contaminants in the burnt gas will eventually gum up the surfaces downstream of the combustion chamber, making flapper operation unreliable.

Figure 8:
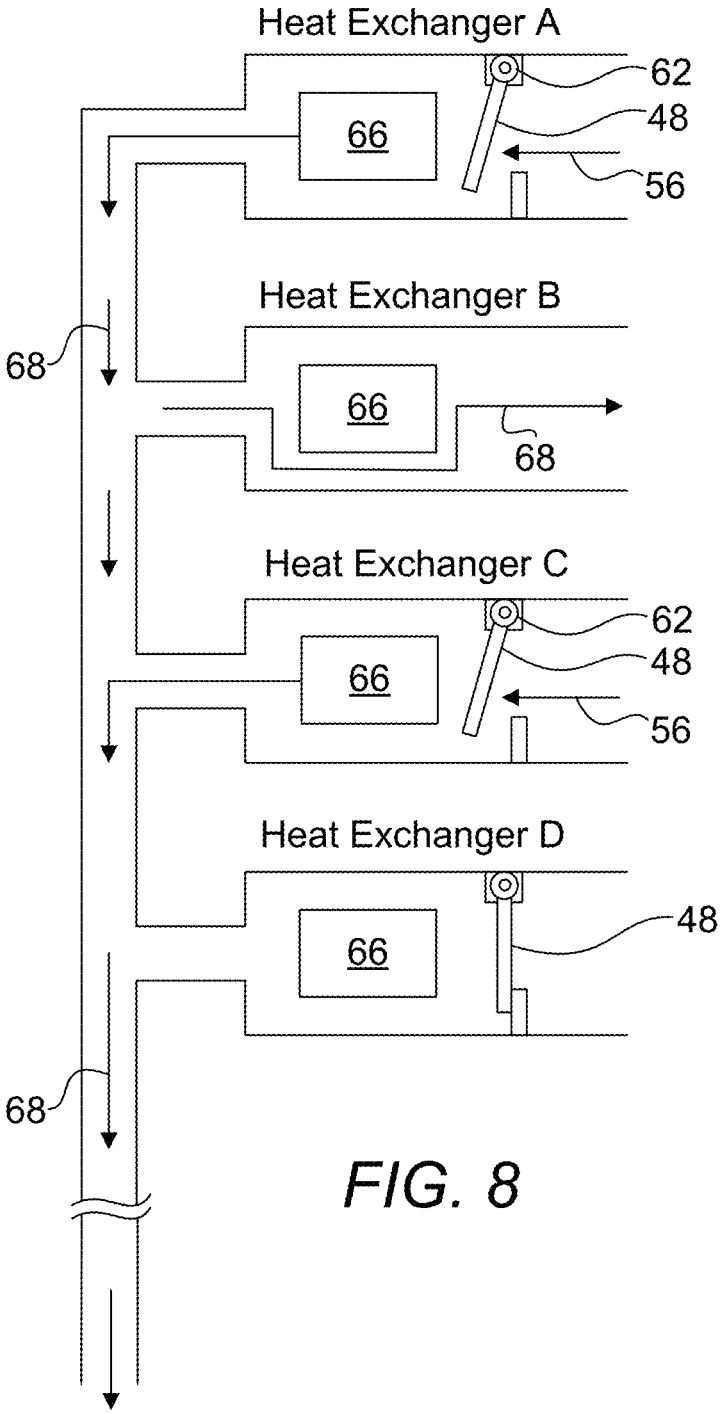
FIG. 8 is a simplified diagram illustrating the function of flappers for heat exchangers sharing a single exhaust manifold.

FIG. 8 is a simplified diagram illustrating the function of flappers 48 for heat exchangers sharing a single exhaust manifold. There are four heat exchangers, i.e., A, B, C and D depicted in this example. Each of the three heat exchangers, i.e., A, C and D is shown having a burner 66 that is disposed downstream from a flapper 48. Heat exchanger B is shown without a flapper 48. Heating is requested of heat exchangers A and C only.

Heating is not requested of heat exchangers B and D. As such, no fuel/air mixture flows 56 are effected in heat exchangers B and D. In heat exchanger A, as flue gas is produced by its burner, it flows in a direction according to the pressure differentials created generally by the blowers disposed upstream of the flappers 48. However, in this example, the blowers of heat exchangers B and D are not turned on as no heating has been requested of either one of the heat exchangers. It shall be noted that, without a flapper 48, heat exchanger B is unable to prevent a flue gas flow 68 from entering its combustion chamber. It shall be noted that, as a flapper 48 is provided to heat exchanger D, no flue gas flow is effected in heat exchanger D as its flapper 48 is disposed in the closed position due to the lack of a fuel/air mixture flow 56 through it. Therefore it shall be apparent that an undesired flue gas flow, as the flow shown going through heat exchanger B, can occur if the exhausts from multiple heat exchangers are commonly vented and that one or more of the heat exchangers lack flappers 48 for flue gas flow control.

Figure 9:
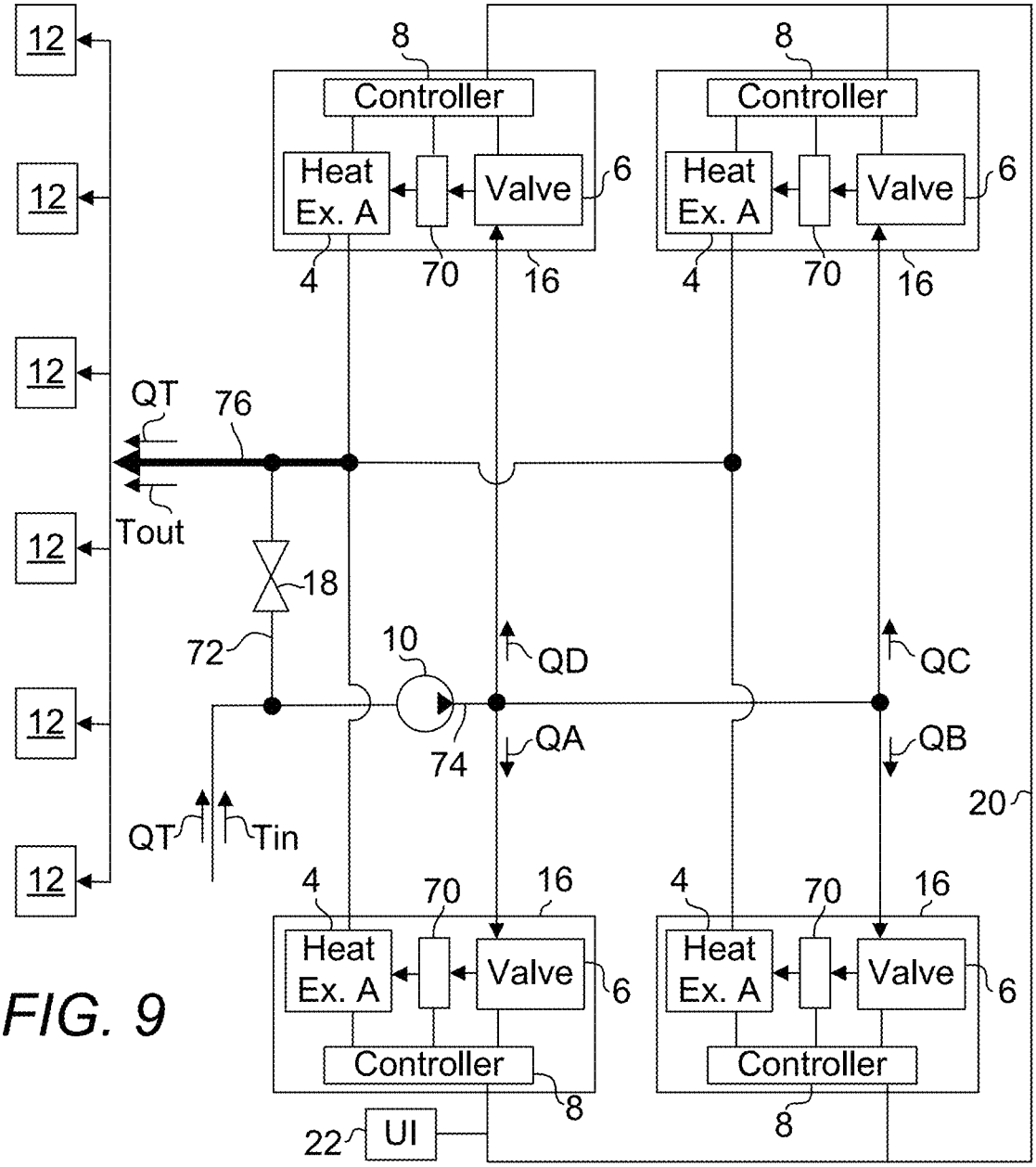
FIG. 9 is a block diagram depicting one embodiment of a water heating system comprised of a single package including multiple heat exchangers and one embodiment of a recirculation and bypass circuit.

FIG. 9 is a block diagram depicting one embodiment of a water heating system comprised of a single package including multiple heat exchangers and one embodiment of a recirculation and bypass circuit. Note, in this embodiment that, the pump 10 is disposed, neither in auxiliary conductor 72 nor outlet conductor 76, but in the inlet conductor 74 disposed on an upstream location of the plurality of heat exchangers 4. As the pump 10 is mounted upstream from the heat exchangers 4, it mobilizes a flow that enters the inlet conductor 72 and "pushes" the flow through the heat exchangers 4. Contrast this to the manner in which a pump mobilizes a flow if the pump is mounted downstream from the heat exchangers 4, e.g., in the outlet conductor 76. A pump mounted downstream from the heat exchangers 4 tends to experience cavitation if a flow path of one of the heat exchangers is closed, e.g., due to clogging, etc. When recirculation is desired, the modulating valve 18 is disposed in a setting suitable for allowing a flow from the outlet conductor 76 to the inlet conductor 74. In one embodiment, it is also possible to allow the bypass of an unheated inlet flow from the inlet conductor 74 to the outlet conductor 76, thereby reducing the pressure drop that would have occurred at some flowrates if the entire flow had been forced to go through the pump. If a bypass of the unheated inlet flow through conductor 72 is used, the temperature setpoint of one or more heat exchangers 4 may be increased to compensate for the bypass flow that is unheated. As the pressure drop incurred by the bypass flow is less than a volumetrically equivalent flow through a heat exchanger 4, the pressure drop caused by the on-demand high volume capable fluid heating system to meet a hot water demand is lowered when the bypass flow is involved in contributing to the heating of a hot water demand without affecting a resultant temperature, i.e., the temperature at which a hot water demand is delivered, and a resultant flowrate of the fluid supply of the on-demand high volume capable fluid heating system, i.e., the flowrate at which the hot water demand is delivered. This is accomplished by increasing a temperature setpoint of one or more of the plurality of heat exchangers 4 to produce a heated flow disposed at an intermediate temperature higher than the resultant temperature and the heated flow is merged with the bypass flow to form the fluid supply at the resultant temperature. It shall be noted that, upon merging with the heated flow, the resultant flow or fluid supply is disposed at the resultant temperature that is higher than a temperature of the bypass flow. If no recirculation or bypass is desired, the modulating valve 18 is shut off.

There is further provided a method for determining the root cause of the lack of flow in an on-demand high volume capable fluid heating system for supplying a total heating power at a turndown ratio and a total flowrate of a fluid supply. During installation, foreign objects, e.g., dirt, grime, etc., or other materials not intended for the fluid conductors of the present system, could be inadvertently introduced in the present system, especially during a replacement of an existing and aging system which has been in operation for an extended period of time. The lack of flow could be a result of a clogged path through a heat exchanger and/or a dysfunctional pump.

In one embodiment, a present fluid heating system includes a controller; a plurality of heat exchangers fluidly connected in parallel, each of the plurality of heat exchangers includes a fluid conductor, wherein each of the plurality of heat exchangers contributes to the total heating power and a portion of the total flowrate of the fluid supply through the fluid conductor; an inlet conductor 74 configured to connect the fluid supply to the plurality of heat exchangers; an outlet conductor 76 configured for receiving the fluid supply downstream of the plurality of heat exchangers; an auxiliary conductor 72 connecting the inlet conductor at a first location and the outlet conductor, the auxiliary conductor including a modulating valve; and a pump disposed downstream from the first location on the inlet conductor. The pump is disposed upstream from the plurality of heat exchangers to prevent cavitation in the fluid heating system. The modulating valve and the pump cooperate to cause a recirculation flow through at least one of the plurality of heat exchangers in a first flow mode from the outlet conductor to the inlet conductor and a bypass flow through the conductor in a second flow mode from the inlet conductor to the outlet conductor and the controller operably connected to the modulating valve. In one operating mode, recirculation can occur either while a demand exists or while no demands are present. If a demand exists, the modulating valve can be disposed in a setting suitable for encouraging a recirculation. If a demand is absent, as long as the modulating valve is not fully closed, a recirculation can occur. In another operating mode, an inlet fluid supply can be bypassed to the outlet conductor to aid in meeting a larger demand. As the bypassed fluid is unheated, the unbypassed portion of the fluid supply must be heated to a higher temperature setpoint to result in a mixture of bypassed and unbypassed portions of the fluid supply suitable for the recipients of the fluid supply.

A blockage can occur in one or more flow paths or the pump can cease or otherwise malfunction, resulting in decreased or no flow in a present fluid heating system. In one step, the flowrate of each the heat exchangers is compared with another flowrate through the other heat exchangers in the system. If the flowrate indicated by each of the flowrate sensors 70 is determined to fall outside of tolerance of the flowrates through a majority of the other heat exchangers of the plurality of heat exchangers, the flowrate sensor of the heat exchanger or a flow path of the heat exchanger is determined to be contributing to the root cause of the lack of flow in the on-demand high volume capable fluid heating system. For instance, if the flowrate of a heat exchanger, as indicated by its respective flowrate sensor differs from the flowrates of more than half of all the heat exchangers by about 50%, at least one of the flowrate sensor in question and the flow path of the heat exchanger associated with it is said to be dysfunctional. For instance, if the flowrate of a heat exchanger is 0.5 GPM and more than half of the other heat exchangers register a flowrate that is 1 GPM or over, then more than half of the heat exchangers register a flowrate that is $(1-0.5)/0.5\times100=100\%$ which is greater than the allowable tolerance, i.e., 50%.

In another step, with a pump turn-on command received at the pump where the pump turn-on command is intended for turning on the pump, the flowrates of the plurality of heat exchangers are compared to a threshold, wherein if a majority of the flowrates of the plurality of heat exchangers are disposed below a threshold, the pump is determined to be contributing to the root cause of the lack of flow in the on-demand high volume capable fluid heating system. For instance, if the majority of flowrates indicated by their respective flowrate sensors, e.g., more than half of the flowrates are determined to be below about 10% of the expected maximum flowrate through each of the heat exchangers, then the pump is said to be dysfunctional. In one operating mode, if the pump had been determined to have malfunctioned or ceased, the modulating valve 18 is closed to prevent any or a significant bypass flow through conductor 72 as there will be insufficient flow through the heat exchangers to be mixed with a bypass flow through conductor 72. In its failed state, the pump still allows a flow through it albeit at a lower flowrate and with a higher pressure drop and is capable in fully meeting the demands of most applications.

Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

What is claimed herein is:

1. A method for controlling an on-demand high volume capable fluid heating system for supplying a total heating power at a turndown ratio and a total flowrate of a fluid supply, said fluid heating system comprising a plurality of heat exchangers fluidly connected in parallel, each of said plurality of heat exchangers comprising: a fluid conductor, wherein each of said plurality of heat exchangers contributes to said total heating power and a portion of the total flowrate of the fluid supply through said fluid conductor; an inlet conductor configured to connect the fluid supply to said plurality of heat exchangers at an upstream location of said plurality of heat exchangers; an outlet conductor configured for receiving the fluid supply downstream of said plurality of heat exchangers; an auxiliary conductor connecting said inlet conductor at a first location and said outlet conductor, said auxiliary conductor comprising a modulating valve; and a pump disposed downstream from said first location on said inlet conductor, wherein said pump is disposed upstream from said plurality of heat exchangers, said method comprising:

(a) controlling said modulating valve to cause a bypass flow through said auxiliary conductor in a first flow mode from said inlet conductor to said outlet conductor; and (b) increasing a temperature setpoint of one or more of said plurality of heat exchangers to produce a heated flow at an intermediate temperature that is higher than a resultant temperature, said heated flow configured to be merged with said bypass flow to form the fluid supply at said resultant temperature; and (c) disposing said modulating valve in a closed position, forcing the fluid supply through said pump and said plurality of heat exchangers such that the fluid supply remains capable of being heated to mitigate a failure of said pump, wherein said modulating valve is disposed in a first setting to cooperate with said pump to generate a first internal circulation through at least one of said plurality of heat exchangers while supplying said total heating power in a second flow mode and said modulating valve is disposed in a second setting to cooperate with said pump to generate a second internal circulation through at least one of said plurality of heat exchangers a portion of the time outside of supplying said total heating power in said second flow mode.

2. The method of claim 1, further comprising controlling said modulating valve and said pump to cause a recirculation flow through said auxiliary conductor and at least one of said plurality of heat exchangers in a third flow mode from said outlet conductor to said inlet conductor.

3. The method of claim 1, wherein said on-demand high volume capable fluid heating system is tankless.

4. The method of claim 1, wherein said on-demand high volume capable fluid heating system further comprises a user interface operably connected to said plurality of heat exchangers.

5. The method of claim 1, wherein said on-demand high volume capable fluid heating system further comprises an enclosure within which said plurality of heat exchangers and said pump are located, said enclosure comprises a pallet base having fork pockets adapted to facilitate the transport of said enclosure with a forklift.

6. The method of claim 1, wherein said on-demand high volume capable fluid heating system further comprises an external recirculation circuit.

7. The method of claim 1, wherein said turndown ratio is at least about 33.3:1.

8. The method of claim 1, wherein the total flowrate is up to about 50 Gallons Per Minute (GPM).

9. The method of claim 1, wherein each of said plurality of heat exchangers further comprises a top casting comprising a backflow preventer.

* * * * *